United States Patent [19]

Hurley et al.

[11] 4,191,617

[45] Mar. 4, 1980

[54] PROCESS FOR ELECTROPLATING DIRECTLY PLATEABLE PLASTIC WITH COBALT ALLOY STRIKE AND ARTICLE THEREOF

[75] Inventors: John L. Hurley, Mahwah, N.J.; Daniel Luch, Warwick; Charles J. Knipple, Cornwall, both of N.Y.

[73] Assignee: The International Nickel Company, Inc., Suffern, N.Y.

[21] Appl. No.: 25,492

[22] Filed: Mar. 30, 1979

[51] Int. Cl.[2] ..... B23P 3/20; C25D 5/10; C25D 5/12; C25D 5/14

[52] U.S. Cl. ..... 204/40; 204/23; 204/41; 204/43 T; 428/626; 428/667; 428/678

[58] Field of Search ..... 428/626, 667, 678; 204/43 T, 41, 20, 30, 40, 23

[56] References Cited

U.S. PATENT DOCUMENTS 3,865,699 2/1975 Luch ..... 204/20

FOREIGN PATENT DOCUMENTS 997898 7/1965 United Kingdom ..... 204/43 T

*Primary Examiner*—G. L. Kaplan

*Attorney, Agent, or Firm*—Francis J. Mulligan, Jr.; Ewan C. MacQueen

[57] ABSTRACT

Discloses the use of nickel-cobalt alloy strike deposits especially ultra-thin nickel-cobalt alloy strike deposits on directly plateable plastics whereby difficulties encountered in plating directly plateable plastics are obviated and plated objects suitable for service conditions 3 and 4 or equivalent service conditions are provided. Especially advantageous results are obtained when the strike deposit contains at least about 30% cobalt.

4 Claims, No Drawings

PROCESS FOR ELECTROPLATING DIRECTLY PLATEABLE PLASTIC WITH COBALT ALLOY STRIKE AND ARTICLE THEREOF

BACKGROUND OF THE INVENTION AND PROBLEM

The present invention is concerned with electroplated directly plateable plastics for conditions equivalent to and more severe than Service Conditions SC3 and SC4 and more particularly with electroplated directly plateable plastics for such service conditions which have nickel-cobalt alloy strike deposits directly and immediately deposited on the directly plateable plastic surface.

As of now, there have been a number of disclosures with respect to plastic compositions which can be electroplated without the need for the use of complex preplating systems which are necessary when electroplating conventional plastics such as ABS. These disclosures include the Luch U.S. Pat. No. 3,865,699, the Hurley et al. U.S. application Ser. No. 827,986 and PRODUCTS FINISHING, January, 1978, pages 78 to 80. Up to now, the use of such "directly plateable plastics" (DPP) has been hindered by the fact that "precautions" as disclosed in Luch U.S. application Ser. No. 735,312 should be taken in order to insure the stability of the strong initial bond which forms between electrodeposited group VIII metal and the plastic substrate when the plated plastic object is subjected to corrosion and thermal cycling tests appropriate to Service Conditions SC3 and SC4.

The terms "Service Conditions SC3 and SC4" are taken from ANSI/ASTM specification B604–75 second 6.3 Service Condition Number which reads as follows:

6.3 Service Condition Number:

6.31 The service condition number indicates the severity of the service conditions in accordance with the following scales:

SC 4—very severe service

SC 3—severe service

SC 2—moderate service

SC 1—mild service 6.32 Typical service conditions for which the various service condition numbers are appropriate are given in Annex A1.

6.4 Coatings Appropriate to Each Service Condition Number—Table I shows the coating classification numbers appropriate for each service condition number.

A1. DEFINITIONS AND EXAMPLES OF SERVICE CONDITIONS FOR WHICH THE VARIOUS SERVICE CONDITION NUMBERS ARE APPROPRIATE

A1.1 Service Condition No. SC 4 (Very severe)—Service conditions that include likely damage from denting, scratching, and abrasive wear in addition to exposure to corrosive environments and temperature extremes; for example, conditions encountered by exterior components of automobiles and by boat fittings in salt water service.

A1.2 Service Condition No. SC 3 (Severe)—Exposure that is likely to include occasional or frequent wetting by rain or dew or strong cleaners and saline solutions and temperature extremes; for example, conditions encountered by porch and lawn furniture, bicycle and perambulator parts, and hospital furniture and fixtures.

A1.3 Service Condition No. SC 2 (Moderate)—Indoor exposure in places where condensation of moisture and temperature extremes may occur; for example, in kitchens and bathrooms.

A1.4 Service Condition No. SC 1 (Mild)—Indoor exposure in normally warm, dry atmospheres with coating subject to minimum wear or abrasion.

Table II of Specification No. B604 specifies Corrosion tests appropriate for each Service Condition number as follows:

| Service Condition Number | Duration of Corrosion (CASS) Test (a) |
|---|---|
| SC 4 | three 16-h cycles(b) |
| SC 3 | two 16-h cycles(b) |
| SC 2 | 8 h |
| SC 1 | — |

Also pertinent is paragraph 5.4 of Standard Recommended practice for Thermal Cycling Test for Evaluation of Electroplated Plastics ASTM B553–71 which reads as follows:

5.4 Subject the sample to a thermal cycle procedure as follows:

| Service Condition | High Limit | Low Limit |
|---|---|---|
| 1 (mild) | 60 C | −30 C |
| 2 (moderate) | 75 C | −30 C |
| 3 (severe) | 85 C | −30 C |
| 4 (very severe) | 85 C | −40 C |

Each thermal cycle begins with either placing the samples in a room-temperature chamber and heating the chamber up to the high limit or placing the samples directly into a chamber as the high limit.

NOTE: Suggested definitions of service conditions appear in the Appendix. Alternatively, the definition may be one agreed upon between the purchaser and seller.

5.41 Expose the parts for 1 h at the high limit.

5.42 Allow the parts to return to 22°±3° C., as quickly as possible and maintain at this temperature for a total cooling period of 1 h. This is frequently accomplished by removing the parts from the chamber, however, some types of apparatus are so constructed that the parts need not be removed during this step.

5.43 Expose the part for 1 h at the lower limit.

5.44 Repeat 5.42. This constitutes one full thermal cycle.

From the foregoing, it is clear that plated plastic articles for Service Conditions SC3 and SC4 must withstand thermal cycling tests having a high limit of 85° C. and a plurality of 16 hour Cass Corrosion Test cycles. These tests are generally considered to be the minimum. Automotive manufacturers have generally stiffened the tests by requiring combined thermal cycle-Cass Corrosion Testing for plated plastic objects designed for exterior automotive use and lengthened and increased the temperature during thermal cycle test periods for plated plastic objects designed for interior automotive use. Interior automotive use, although a use in only a mildly corrosive environment, is nevertheless equivalent to Service Conditions SC3 or SC4 because of the high temperatures which can exist in an automobile interior when the car is left closed on a hot, sunny day.

The reasons why the "precautions" disclosed in U.S. application Ser. No. 735,312 were deemed necessary when providing plated objects made of directly plateable plastic for exterior automotive use are set forth in the record in that application. In order that the art may be fully aware of the problems encountered in the plating of directly plateable plastics, this background, heretofore believed to be solely within the knowledge of applicants, their assignee, their co-workers, and the Patent Office, is paraphrased as follows:

'In U.S. Pat. No. 3,865,699 Luch disclosed that a polymer composition containing carbon black and sulfur reacted with group VIII metal electrodeposited on the polymer surface so as to enhance the rate of coverage of the polymer surface and to provide a strong metal-polymer bond. During the development work carried out in order to translate the patentable discovery of U.S. Pat. No. 3,865,699 into a commercial reality, it was found that the strong bond initially obtained between the polymer composition and the metal, specifically nickel, could be degraded by means, which for many months, remained obscure.'

'After considerable development effort, Luch discovered that the bond between plastic composition and the electroplated metal was destroyed or minimized by certain active chemical species exemplified by active or nascent hydrogen and free radicals. Nickel plating is rarely seen by the public. Nevertheless, it is an indispensible underlayer for the bright chromium plating that is ubiquitous on the modern American automobile. During the development work, Luch had been refining the techniques for plating nickel on various plastic objects with excellent success without taking the final step of plating a few microinches of chromium on the surface. He reasoned that if the underlayment was firmly bonded to the plastic, the outer layer of chromium would make no appreciable difference. When he finally plated chromium on the nickel-plated plastic surface, after a mild heating of the plated, plastic object' he found to his chagrin that plating the final, this outer layer of chromium caused the inner metal-plastic bond to drastically weaken.

One cause of the problem was isolated by an experiment involving a nickel plated plastic containing carbon black and sulfur as a cathode in an aqueous acidic solution thereby generating hydrogen on the cathode surface. When the plastic was employed as a cathode for the production of hydrogen, bond strength, after heating, was destroyed. It was thus proven that the formation of hydrogen incidental to the electrodeposition of chromium was a cause of failure of the plated plastic. In a similar manner, active chemical species, perhaps free radicals or nascent hydrogen, remaining in the polymer-carbon-black-sulfur plastic mass as a result of compounding or molding also act in some manner to destroy or minimize the bond between the electroplated metal and the plastic substrate.

Once the causes of the problem were uncovered, a solution thereto was relatively simple. First, after molding an object to be plated, the molded object should be "aged" to allow free radicals or their equivalents to dissipate. Secondly, once an initial layer of group VIII metal is plated on the carbon-black-sulfur-polymer substrate, that layer must be isolated from contact with nascent hydrogen.

The two numbered statements in the preceding paragraph embody the principal features of the precautions which, heretofore, have been necessary in order to successfully electroplate, for use in severe corrosion environments, directly plateable plastic objects made of a composition containing polymer, carbon black and sulfur.

DISCOVERY AND OBJECTS

It has now been discovered that the circumstances described in the foregoing paraphrase which have heretofore hindered the use of directly plateable plastics can be overcome by a simple expedient as disclosed herein and defined by the claims.

It is an object of the present invention to provide novel electroplated plastic structures for use under service condition SC3 and more severe service conditions and a process for making such structures.

Other objects and advantages will become apparent from the following description.

GENERAL DESCRIPTION

Generally speaking the present invention contemplates a plated plastic object suitable for Service Conditions 3 and more severe service conditions characterized by ability to pass a combined thermal cycle—CASS test or lengthened thermal exposure or cycle tests comprising (a) a base of directly plateable plastic (as hereinafter defined) (b) an electrodeposit of nickel-cobalt alloy (as hereinafter defined) directly adhered to said directly plateable plastic base (c) one or more layers of nickel or copper and nickel atop said electrodeposit of alloy said nickel being corrosion-resistant electrodeposited nickel (as hereinafter defined) and (d) a decorative electrodeposit of chromium on the surface of said plated plastic object.

For purposes of this specification and claims, a directly plateable plastic (DPP) is a composition containing a polymer, carbon black and sulfur as disclosed in U.S. Pat. No. 3,865,699. A particularly advantageous DPP is disclosed in U.S. application Ser. No. 827,986 filed in the name of Hurley et al. on Aug. 26, 1977, and incorporated herein by reference. This application discloses and claims DPP's having compositions within the following ranges:

| INGREDIENT | % BY WT. |
|---|---|
| Carbon black | 25–41 |
| Elemental sulfur | 0.15–1.5 |
| MBT or MBTS | 0.2–1.5 |
| ZnO | 0–7 |
| Polymer* | Balance essentially |
| S/MBT or MBTS | 0.5–6.0 |

*The polymer is from the group of ethylene-propylene copolymers, propylene and ethylene homopolymer, and propylene and ethylene homopolymers or copolymers in admixture with a saturated rubber flexiblizer said admixture having a weight ratio of rubber to homopolymer or copolymer of up to 1.

Compositions of matter within the foregoing ranges in the melt-blended and cooled condition generally have electrical resistivities below about 200 ohm-centimeters.

For purposes of this specification and claims, nickel-cobalt alloys contain, in percent by weight, at least about 40% nickel and at least about 10% cobalt, i.e., about 15% to 60% cobalt, balance essentially nickel with nickel comprising at least about 40% the composition.

For purposes of the present specification and claims, the term "corrosion resistant electrodeposited nickel"

means any nickel electrodeposit consisting essentially of pure nickel or nickel plus cobalt and specifically includes electrodeposited nickel containing small amounts of sulfur and/or other residuums from brightening, leveling and/or stress relieving agents in plating baths.

The plated plastic product of the present invention is made by molding a DPP into any desireable shape and, after at most a minimal aging, inserting the molded object as a cathode into a plating bath capable of codepositing nickel and a minimum amount of cobalt onto the cathode. As previously disclosed with respect to nickel, the potential is initially maintained at a low level and gradually increased in order to allow the plastic object to be completely covered with metal without burning. Higher voltage can ordinarily be applied after a few minutes and thereafter plating can proceed normally to deposit a strike layer of nickel-cobalt alloy, a superimposed layer or layers of corrosion resistant nickel or copper plus nickel and, usually, a top layer of chromium.

As stated hereinbefore, the principal problems which have occurred in plating DPP heretofore are disclosed in the Luch U.S. application Ser. No. 735,312 and these disclosures are incorporated herein by reference. Among these problems, the most serious is that caused by the release of hydrogen during the electrodeposition of bright nickel and chromium. Nascent hydrogen released during bright nickel and chromium plating at least initially permeates the electroplated metal, and up to now, unless a hydrogen barrier such as a copper layer is in the plate, a nickel-plastic bond will fail when the plated object is subjected to thermal cycling. When, in accordance with the present invention, a nickel-cobalt alloy is directly adhered to the plastic, the plastic object can be top-plated with chromium in the absence of a hydrogen barrier and the plastic metal bond will not fail during subsequent thermal cycling. Applicants have no explanation for this phenomenon. In accordance with the present invention, the nickel-cobalt layer directly deposited on the DPP surface can be very thin, i.e., as thin on the average of about 0.3 micron provided that the remainder of strike thickness, i.e., about 2 microns, is made up with nickel, advantageously Watts nickel, when a layer of copper is to be used over the strike deposit.

The present invention is concerned solely with electroplated plastic objects suitable for service conditions at least as severe as service condition SC3, for example, exterior automotive usage where the plated object is subjected in use to corrosion and a wide range of service temperatures, i.e., from frigid arctic to tropical and also for conditions such as interior automotive usage where service temperatures can be very high.

PARTICULAR DESCRIPTION

Table I identifies a number of prior art documents which disclose baths from which and methods by which nickel-cobalt alloy electrodeposits can be made.

TABLE I

| U.S. Pat. No. | INVENTOR | DATE |
|---|---|---|
| 2,963,784 | Chester | Dec., '60 |
| 3,093,557 | Cope et al. | June, '63 |
| 3,111,463 | Tan et al. | Nov., '63 |
| 3,922,209 | Passal | 11/25/75 |
| 4,010,084 | Brugger et al. | 3/01/77 |
| 4,036,709 | Harbulak | 7/19/77 |
| 4,053,373 | McMullen et al. | 10/11/77 |

TABLE I-continued

| U.S. Pat. No. | INVENTOR | DATE |
|---|---|---|
| 4,069,112 | Harbulak | 1/17/78 |

Electrodeposition of Alloys A. Brenner Academic Press 1963.

Nickel-cobalt alloys have been produced from baths which are essentially Watts nickel baths modified by the replacement of part of the nickel with cobalt. Similar results can be obtained using all-chloride, all-sulfate or all-sulphamate nickel plating baths. Operable ranges of composition and operating conditions of such modified Watts baths are set forth in Table II.

TABLE II

| INGREDIENT | RANGE | DESIRABLE |
|---|---|---|
| Ni | 2–80 g/l | 4.6 g/l |
| Co | 1–10 g/l | 4.5 g/l |
| $SO_4^=$ | 90–120 g/l | 108.2 g/l |
| Cl | 4–30 g/l | 15.6 g/l |
| $H_3BO_3$ | 20–60 g/l | 41.9 g/l |
| pH | 2.0–5.0 | 3.7 |
| Temperature | 25°–75° C. | 57° C. |
| Surface Tension | 29–45 Dynes/cm | 34 Dynes/cm |
| Cathode Current Density | 0.16–6.0 a/dm$^2$ | 0.65 a/dm$^2$ |
| Co/Ni | 0.02–0.12 | 0.07 |

It is important to not that the alloy deposited from baths, the compositions of which are set forth in Table II is not necessarily the same as the ratio of metal ions in the bath. Generally speaking the cobalt content of the deposited alloy increases (a) with the cobalt content in the bath, and (b) as the cathode current density decreases.

Strike plating of directly plateable plastic in any of the baths disclosed in the aforelisted documents in Table I, or the baths of Table II should be done in accordance with normal practice as taught in the art except that voltage ramping is normally used in order to achieve complete coverage of the plastic object. Ramping can be conveniently done by applying a voltage of one volt for 1 minute, 2 volts for a second minute and 3 volts for a third minute. Other ramping sequences can also be used. Full or higher amperage is then after applied for such time as is necessary to complete a strike deposit about 1.0 to about 5.0 μm thick taking care that the plating bath is switched at the appropriate time when only a very thin initial nickel-cobalt deposit is desired. Thereafter plating can be carried out in any fashion desired with no necessity for any hydrogen barrier layer to be present in the total plate.

In accordance with a most preferred aspect of the present invention only the initial portion of strike deposit is nickel-cobalt alloy. Specifically, the nickel-cobalt alloy directly deposited on DPP can be about 0.1 to about 0.5 μm thick with the remainder of the strike deposit being a nickel electrodeposit, for example, a Watts nickel electrodeposit. If, except for a surface chromium layer, the electroplate on DPP is all-nickel, the ultra-thin nickel-cobalt alloy layer (i.e., about 0.1 to 0.5 μm layer) can be the total strike layer over which the Watts nickel, semi-bright nickel, etc. layers can be plated. If however the total plate is to contain copper, it is necessary for a full strike layer thickness of about 1 to 5 μm to be built up with nickel before copper is deposited. In other words, there must be a nickel deposit at least about 0.9 μm thick between the strike alloy and the copper. Failure to build up a full strike thickness with nickel will usually result in a depletion of nickel-cobalt strike deposit in recessed areas during subsequent copper plating.

EXAMPLES

A series of tests were conducted for the purpose of determining minimum amounts of cobalt which would be effective to prevent destruction of a metal-polymer bond when a fully plated nickel-chromium test plaque is subjected to 85° C. for 16 hours. For the purposes of these tests, the following materials and procedures were used:

Directly Plateable Plastic comprising in percent by weight about 30.5% carbon black, about 0.6% each of elemental sulfur and mercaptobenzothiazole, about 2.53% zinc oxide, about 4.76% mineral oil with the balance being essentially ethylene-propylene copolymer was used. This composition was molded into 7.62×10.16 cm test plaques which were aged either 4 days or 6 days prior to plating.

The test plaques were initially strike plated with a number of different baths and then uniformly were plated with about 20 μm of semi-bright nickel from a PERFLOW bath, about 7.6 μm bright nickel from a UDYLITE 66 bath and about 0.38 μm regular chromium from a non-proprietary bath containing 250 g/liter $CrO_3$ and 2.5 g/liter of sulfate ion. Strike platings were as follows:

A 100% Ni Watts bath

B 100% cobalt—made up by dissolving about 400 grams of cobalt sulfate heptahydrate, about 37 grams of boric acid and about 20 grams of cobalt chloride hexahydrate in water to provide a liter of solution and adjusting the pH with sulfuric acid to about 4.0

C 65% Ni—35% cobalt* prepared by adding cobalt sulfate to a Watts bath to obtain a cobalt content of 6.2 g/liter.

D 75% Ni—25% cobalt* prepared by adding cobalt sulfate to a Watts bath to obtain a cobalt content of 2.4 g/liter.

E 87% Ni—13% cobalt* prepared by adding cobalt sulfate to a Watts bath to obtain a cobalt content of 0.6 g/liter.

F 92% Ni—8% cobalt* prepared by adding cobalt sulfate to a Watts bath to obtain a cobalt content of 0.25 g/liter.

*Alloy compositions are nominal and were determined on the basis of platings on foil done in simulation of strike plating conditions.

Approximately the same procedure was used for depositing the strike coatings. This involved voltage "ramps" of 1 V for 30 sec., 2 V for 30 sec., 3 V for 30 sec., and 50 A/ft$^2$ for 4 minutes. Generally, additional time at 3 V was required for complete metal coverage prior to the 4 minutes final strike coating.

Following completion of plating with nickel and chromium, plaques were exposed at 85° C. for 16 hours and then tested for coating adhesion in a qualitative peel test. Plate adhesion was rated on a scale of 0–5 (5=best) as follows:

0—Coating separated from plastic on cooling.

1—Slight flexing of panel resulted in coating separation.

2 through 4—Increasing difficulty to peel coating from plastic.

5—Could not peel coating from plastic.

It would appear that peel ratings greater than 3 are needed for a practical strike coating.

Results of the tests are set forth in Table III.

TABLE III

| Test No. | Plaque Age (Days) | Strike Bath | Highest Peel Rating |
|---|---|---|---|
| 1 | 4 | A | 0 |
| 2 | 6 | A | 1 |
| 3 | 6 | B | No adhesion after strike |
| 4 | 6 | C | 4 |
| 5 | 6 | D | 5 |
| 6 | 6 | E | 5 |
| 7 | 6 | F | 3 |

Table III shows that Strike Baths A (100% nickel Watts bath), and B (100% cobalt) are unsuited as a basis for an all-nickel (topped with chromium) plate on directly plateable plastic when service conditions require resistance to damage caused by heating to 85° C. (Service Conditions SC3 and SC4). While these particular tests did not include subjecting specimens to thermal cycles, they did involve exposure of the specimens to 85° C. for longer than normally tested and showed by test No. 7 wherein the strike layer containing 8% cobalt was used that a minimum amount of cobalt is required in strike alloys to give thermal stability to the strike alloy-plastic bond when the strike alloy is adjacent metal containing hydrogen produced during chromium deposition.

Table IV sets forth additional bath compositions and operating conditions for strike baths.

TABLE IV

| Bath No. | 1 | 2 | 3 | 4 | 5 | 6 | 7 |
|---|---|---|---|---|---|---|---|
| Ni (g/l) | 80.4 | 64.4 | 64.4 | 62.5 | 63.3 | 74.6 | 64. |
| Co (g/l) | — | 0.03 | 0.54 | 1.3 | 2.5 | 4.5 | 12. |
| $SO_4^=$ (g/l)* | 110.7 | 89.8 | 90.7 | 88.7 | 91.9 | 108.2 | 110. |
| Cl (g/l) | 15.4 | 11.5 | 11.5 | 11.5 | 11.6 | 15.6 | 11. |
| $H_3BO_3$ | 38.3 | 41.5 | 41.5 | 36.2 | 44.1 | 41.9 | 30. |
| pH | 3.7 | 3.8 | 3.7 | 3.7 | 3.7 | 3.7 | 3. |
| Temp. °C. | 57 | 57 | 57 | 57 | 57 | 57 | 57 |
| Surf. Tens. dynes/cm | 34 | 34.5 | 34 | 34 | 34 | 34.5 | 34 |

*Calculated value

Using Bath No. 6, the average amount of cobalt in an electrodeposit of Ni-Co alloy was measured and compared to the cathode current density used in making the electrodeposit. The resultant data, set forth in Table V shows lowering of cobalt content with increase in cathode current density.

TABLE V

| Current Density (a/dm$^2$) | Co (%) |
|---|---|
| 0.32 | 39.0 |
| 0.65 | 35.1 |
| 1.29 | 31.4 |
| 2.58 | 24.1 |
| 5.16 | 16.4 |

The data in Table VI shows that, given a particular cathode current density, the cobalt content of an alloy electrodeposit increases with concentration of cobalt in the plating bath.

TABLE VI

| Bath No. | Co Conc g/l | Co as % total Ni+Co in Bath | % Co in deposited Alloy @0.65 a/dm$^2$ | @5.16 a/dm$^2$ |
|---|---|---|---|---|
| 3 | 0.54 | 0.8 | 9.8 | 3.6 |
| 4 | 1.3 | 2.0 | 18.4 | 7.7 |
| 5 | 2.5 | 3.8 | 30 | 16 |
| 6 | 4.5 | 5.7 | 35.1 | 16.4 |
| 7 | 12.0 | 15.7 | 48 | 32 |

Accordingly in light of the teachings of Tables V and VI, those skilled in the art will appreciate the need for correlating bath composition and deposition cathode current density in order to maintain a deposited nickel-cobalt strike alloy within the operable composition range disclosed herein.

Bath No. 6 was used, along with or in part or total substitute for a Watts nickel bath (Bath 1), to provide strike deposits on wheel spinners molded of DPP the composition of which is set forth hereinbefore. The wheel spinners are in the shape of a "pilgrims hat" about 5.7 cm from brim to crown and about 7.6 cm in diameter at the brim exclusive of five equally spaced lugs, each having a mounting hole, around the outside of the brim. The wheel spinners were molded from the DPP which had been pre-heated for 4 hours at 118° C. prior to molding and were then aged from 2 to 6 days after molding and before plating in batches of 12. Details of the plating are set forth in Table VII.

The data in Tables VII and VIII shows that initial striking of the DPP surface with nickel-cobalt alloy provides good nickel-chromium deposits resistant to thermal degradation and corrosion regardless of whether a copper interlayer is present. The presence of a copper layer in the samples of racks D and E improves somewhat on the good corrosion resistance ratings exhibited by the samples of racks A and B.

Spinners, as described hereinbefore, were molded of dried (8 hr) DPP and plated the day after molding. The strike bath used in plating these spinners was Bath 6 as set forth in Table IV. Twelve spinners were struck in Bath 6 at 1 volt for one minute, 2 volts to complete coverage (about 2 minutes) and 1.8 volts at 0.54 a/dm$^2$ for 1.5 minutes. Plating was completed, in sequence, with 2.03 μm of Watts nickel, 14.2 μm of bright acid copper, 10.7 μm of semi-bright nickel, 6.4 μm of bright nickel, 2.03 μm of Durnickel and 0.25 μm of chromium for a total deposit thickness of 34.8 μm. Table IX sets forth the result of thermal degradation tests in terms of plate-to-plastic bond failures in the spinner body (out of 12) and in the spinner lugs (out of 60).

TABLE VII

| RACK | A | B | C | D | E | F |
|---|---|---|---|---|---|---|
| Initial Strike | | | | | | |
| Type | Ni—Co | Ni—Co | Watts | Ni—Co | Ni—Co | Watts |
| Thickness (μm) | 1.25 | 0.25 | 0.28 | 0.29 | 0.18 | 0.26 |
| Max. Av. CD (a/dm$^2$) | 1.35 | 0.60 | 0.60 | 0.66 | 0.41 | 0.60 |
| Balance Strike | See Below | See Below | See Below | None | | See Below |
| Type | — | — | — | — | Watts | — |
| Thickness (μm) | — | — | — | — | 0.19 | — |
| Max. Av. CD (a/dm$^2$) | — | — | — | — | 0.66 | — |
| Balance of Deposit | Ni+Cr | Ni+Cr | Ni+Cr | Cu+Ni+Cr | Cu+Ni+Cr | Ni+Cr |
| Thickness Watts @ 5.5 a/dm$^2$ (μm) | — | 4.32 | 4.32 | — | — | 4.32 |
| Thickness Bright Acid Copper @4.5 a/dm$^2$ (μm) | — | — | — | 11.4 | 11.4 | — |
| Thickness Semi Bright Ni @5.5 a/dm$^2$ (μm) | 21.1 | 18.0 | 18.0 | 11.2 | 11.2 | 18.0 |
| Thickness Bright Ni @ 5.5 a/dm$^2$ (μm) | 5.3 | 5.3 | 5.3 | 5.3 | 5.3 | 5.3 |
| Thickness Dur Ni @ 5.5 a/dm$^2$ (μm) | 2.8 | 2.8 | 2.8 | 2.8 | 2.8 | 2.8 |
| Thickness Cr @ 12.4 a/dm$^2$ ( μm) | 0.43 | 0.43 | 0.43 | 0.43 | 0.43 | 0.13 |
| Total thickness (μm) | 31.0 | 31.2 | 31.2 | 31.5 | 31.5 | 31.2 |
| Days aging before Plating | 2 | 2 | 3 | 3 | 6 | 25 |

The plated wheel spinners from racks A to F were subjected to thermal degradation and CASS corrosion testing with results as set forth in Table VIII.

TABLE VIII

| RACK | A | B | C | D | E | F |
|---|---|---|---|---|---|---|
| Therm. Deg. Test Failure of Spinner bodies | | | | | | |
| 85° C. - 16 hours cool to Room temp. | 0 | 0 | all 12 failed | 0 | 0 | not run |
| plus −30° C. - 2 hours | 0 | 0 | not run | 0 | 0 | not run |
| CASS Corrosion Test 4–16 hour cycles total 64 hours (Rating) | 9.2/7.8 | 9.8/8.0 | not run | 10/7.0 | 10/8.8 | 10/5.8 |
| Superimposed on Thermal Degradation Test | Yes | Yes | — | Yes | Yes | No |

TABLE IX

| First Cycle | | Second Cycle | | Third Cycle | |
|---|---|---|---|---|---|
| 85° C. −30° C. | 16 hrs 2 hrs | 85° C. −30° C. | 16 hrs 2 hrs | 85° C. −30° C. | 16 hrs 2 hrs |
| 85° C. | −30° C. | 85° C. | −30° C. | 85° C. | −30° C. |

TABLE IX-continued

| | First Cycle | | Second Cycle | | Third Cycle | |
|---|---|---|---|---|---|---|
| | 85° C. −30° C. | 16 hrs 2 hrs | 85° C. −30° C. | 16 hrs 2 hrs | 85° C. −30° C. | 16 hrs 2 hrs |
| Body | 0 | 0 | 0 | 0 | 0 | 1* |
| Lugs | 0 | 0 | 0 | 0 | 0 | 0 |

*Isolated spot near crown of the spinner about 2.5 mm. in diameter and primarily plastic delamination.

The data in Table IX shows that by using a nickel-cobalt alloy strike there is no need for aging molded DPP more than 1 day after molding to avoid failure under reasonable thermal degradation testing.

Sixty additional spinners were given nickel-cobalt alloy strikes in baths set forth in Table VI at a cathode current density of about 0.65 a/dm$^2$ by holding at 1 volt for 1 minute, 2 volts for 2 to 2.5 minutes for complete coverage and 1.8 volts for 1.5 minutes. Twelve additional spinners were struck in a cobalt-free Watts bath in the same manner. The 72 spinners were then finish plated by depositing, in sequence, 2.03 μm of Watts nickel, 14.2 μm of bright acid copper, 10.7 μm of semi-bright nickel, 6.4 μm of bright nickel, 2.03 μm of Dur-nickel and 0.25 μm of chromium for a total deposit thickness of 34.8 μm. Table X sets for the results of thermal degradation tests on these 72 spinners.

TABLE X

| | First Cycle | | Second Cycle | | Third Cycle | | |
|---|---|---|---|---|---|---|---|
| | 85° C. −30° C. | 16 hrs 2 hrs | 85° C. −30° C. | 16 hrs 2 hrs | 85° C. −30° C. | 56 hrs 2 hrs | |
| Estimated % Co | Failures after | | Failures after | | Failures after | | |
| in Strike Deposit | 85° C. | −30° C. | 85° C. | −30° C. | 85° C. | −30° C. | −48° C.* |
| 0 | 1 | 1 | 1 | 1 | 3 | 7 | 9 |
| 9.8 | 2 | 2 | 2 | 3 | 3 | 9 | 12 |
| 18.4 | 0 | 0 | 0 | 0 | 0 | 0 | 1 |
| 30 | 0 | 0 | 0 | 0 | 0 | 0 | 0 |
| 35 | 0 | 0 | 0 | 0 | 0 | 0 | 0 |
| 48 | 0 | 0 | 0 | 0 | 0 | 0 | 0 |

*Cooled 3 hours then held at −46° to −50° C. for 1.5 hours

Table X shows the advantage in using very thin (i.e., about 0.1 μm to about 0.6 μm) cobalt-nickel alloy strike deposits which, on the average, contain greater than about 30% cobalt, e.g., about 30% to about 60% cobalt, balance nickel. None of the 36 spinner samples struck with such an alloy deposit failed in the extremely severe thermal degradation test comprised of the three cycles as set forth in Table X.

Examination of lug areas on the samples tested as reported in Table X showed 151 failures out of 180 possibles with samples struck with either pure nickel or nickel-cobalt alloy estimated to contain less than 20% cobalt. Of those samples struck with nickel-cobalt alloy estimated to contain from 30% to 50% cobalt, there were only 10 failures out of 180 samples tested.

A second set of spinners was plated in a manner similar to manner in which the aforementioned sixty spinners were plated. These additional spinners were tested under conditions as set forth in Table XI.

TABLE XI

| | Failure of Lugs 100° C. for 16 hrs −30° C. for 2 hrs % Failures after | | Failure of Body 100° C. for 16 hrs −30° C. for 2 hrs % Failures after | |
|---|---|---|---|---|
| Estimated Cobalt in Strike Deposit | 100° C. | −30° C. | 100° C. | −30° C. |
| 0% | 53% | 77% | 0% | 83% |
| 9.8% | 0% | 96% | 0% | 0% |
| 18.4% | 0% | 20% | 0% | 0% |
| 30% | 0% | 0% | 0% | 0% |

The data in Table XI shows, again the highly advantageous results obtained when nickel-cobalt alloy strike layers contain about 30% cobalt.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A process for electroplating directly plateable plastic comprising initially electrodepositing, directly on the plastic surface, an alloy containing about 10% to about 60% cobalt, balance essentially nickel and thereafer continuing electrodepositing electrodepositable metal on said plastic while maintaining said nickel-cobalt alloy at said plastic surface.

2. A process as in claim 1, wherein the alloy contains about 30% to about 60% cobalt.

3. A process as in claim 1, wherein the initial deposit of alloy is about 0.1 to about 0.5 μm thick and is directly coated with a nickel electrodeposit at least about 0.9 μm thick.

4. An electroplated, directly plateable plastic object having directly adhered to the plastic surface thereof an electrodeposited nickel-cobalt alloy containing about 10% to about 60% cobalt.

* * * * *